US009638002B2

(12) United States Patent
Richards

(10) Patent No.: US 9,638,002 B2
(45) Date of Patent: May 2, 2017

(54) ACTIVATED REVERSE-OUT VALVE

(71) Applicant: Halliburton Energy Services, Inc., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 279 days.

(21) Appl. No.: 14/386,350

(22) PCT Filed: Nov. 1, 2013

(86) PCT No.: PCT/US2013/068047
§ 371 (c)(1),
(2) Date: Sep. 19, 2014

(87) PCT Pub. No.: WO2015/065474
PCT Pub. Date: May 7, 2015

(65) Prior Publication Data

US 2016/0237783 A1 Aug. 18, 2016

(51) Int. Cl.
*E21B 43/04* (2006.01)
*E21B 34/10* (2006.01)
(Continued)

(52) U.S. Cl.
CPC ..... *E21B 34/10* (2013.01); *E21B 34/14* (2013.01); *E21B 43/04* (2013.01); *E21B 43/045* (2013.01); *E21B 2034/005* (2013.01)

(58) Field of Classification Search
CPC ..... E21B 34/10; E21B 34/14; E21B 34/00; E21B 34/06; E21B 43/045; E21B 2034/005
See application file for complete search history.

(56) References Cited

U.S. PATENT DOCUMENTS 4,295,524 A * 10/1981 Baker ..... E21B 43/045 166/127
5,159,981 A * 11/1992 Le ..... E21B 34/06 137/515

(Continued)

FOREIGN PATENT DOCUMENTS

WO 2015065474 A1 5/2015

OTHER PUBLICATIONS

International Search Report and Written Opinion for PCT/US2013/068047 dated Jul. 24, 2014.

*Primary Examiner* — Robert E Fuller
*Assistant Examiner* — David Carroll
(74) *Attorney, Agent, or Firm* — McDermott Will & Emery LLP

(57) ABSTRACT

A disclosed reverse-out valve includes an upper mandrel, a lower mandrel movable with respect to the upper mandrel, and a reverse activated plug device arranged on the upper mandrel and including a piston arranged within a piston chamber of the upper mandrel and a prop extending longitudinally from the piston, wherein the piston chamber includes a first end and a second end, the reverse activated plug device further including a closure device movable between an open position where the piston is arranged at the first end and the prop holds the closure device open such that a reverse-circulation fluid is able to bypass the reverse activated plug device, and a closed position, where the piston is arranged at the second end and the prop is moved to allow the closure device to close and thereby prevent the reverse-circulation fluid from bypassing the reverse activated plug device.

23 Claims, 8 Drawing Sheets

(51) Int. Cl.
*E21B 34/14* (2006.01)
*E21B 34/00* (2006.01)

(56) References Cited

U.S. PATENT DOCUMENTS

| | | | | |
|---|---|---|---|---|
| 2006/0070744 | A1 | 4/2006 | Smith | |
| 2007/0114043 | A1 | 5/2007 | Richards et al. | |
| 2008/0314589 | A1 | 12/2008 | Guignard et al. | |
| 2011/0048723 | A1 | 3/2011 | Edwards | |
| 2011/0067861 | A1* | 3/2011 | Clem | E21B 43/045 166/278 |
| 2015/0075780 | A1* | 3/2015 | Richards | E21B 17/04 166/250.1 |
| 2015/0211334 | A1* | 7/2015 | Richards | E21B 43/04 166/373 |
| 2016/0003013 | A1* | 1/2016 | Eliseev | E21B 43/14 166/278 |
| 2016/0102525 | A1* | 4/2016 | Ross | E21B 23/06 166/250.01 |

* cited by examiner

ACTIVATED REVERSE-OUT VALVE

BACKGROUND

This present disclosure is related to the treatment of subterranean production intervals and, more particularly, to a reverse-out valve that minimizes swabbing of the formation caused by service tool manipulations during the well treatment operation.

In the oil and gas industry, particulate materials such as sand and other wellbore debris are often produced to the surface during the extraction of hydrocarbons from a well traversing unconsolidated or loosely consolidated subterranean formations. Producing such particulate matter can cause abrasive wear to components within the well, such as tubing, pumps, and valves, and can sometimes partially or fully clog the well creating the need for an expensive workover operation. Also, if the particulate matter is produced to the surface, it must be removed from the extracted hydrocarbons by various processing equipment at the surface.

In order to prevent the production of such particulate material to the surface, unconsolidated or loosely consolidated production intervals in the well are often gravel packed. In a typical gravel pack completion, a completion string including a packer, a circulation valve, a fluid loss control device and one or more sand control screens, is lowered into the wellbore to a position proximate the desired production interval. A service tool is then positioned within the completion string and a fluid slurry that includes a liquid carrier and a particulate material (i.e., gravel) is then pumped through the circulation valve and into the well annulus formed between the sand control screens and the perforated well casing or open hole production zone. The liquid carrier either flows into the adjacent formation or returns to the surface by flowing through the sand control screens, or both. In either case, the gravel is deposited around the sand control screens to form a gravel pack, which is highly permeable to the flow of hydrocarbon fluids but simultaneously blocks the flow of the particulate material often carried in the hydrocarbon fluids. As such, gravel packs can successfully prevent the problems associated with the production of particulate materials from the formation.

During gravel packing operations, the service tool used to deliver the gravel slurry must be operated between various positions. For example, the service tool typically has a run-in configuration, a gravel slurry pumping configuration and a reverse-out configuration. In order to operate the service tool between these positions, the service tool is axially manipulated relative to the completion string. In addition, the service tool is often used to open and close the circulation valve, which also requires the axial movement of the service tool relative to the completion string. Such axial movement of the service tool, however, can adversely affect the surrounding formation. For instance, movement of the service tool uphole relative to the completion string can undesirably draw production fluids out of the formation, and movement of the service tool downhole can undesirably force wellbore fluids into the formation. This type of swabbing can damage the formation, including causing damage to the filter cake in an open hole completion.

To avoid detrimental swabbing of the wellbore, some tools use a weep tube to move the service tool string. The weep tube allows a controlled rate of fluid to transfer through the service tool and thereby maintain hydrostatic pressure on the surrounding formation. While weep tubes work well for reducing tool movement, weep tubes can also undesirably fracture the surrounding formation during reverse-out operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

This present disclosure is related to the treatment of subterranean production intervals and, more particularly, to a reverse-out valve that minimizes swabbing of the formation caused by service tool manipulations during the well treatment operation.

The embodiments disclosed herein provide reverse-out valves used with a completion string and service tool. The reverse-out valves generally include a ball check and a reverse activated plug device arranged uphole therefrom. The ball check has a weeping feature used to allow a metered amount of fluid to bypass the ball check and thereby maintain hydrostatic pressure on the formation. This may be advantageous in preventing undesirable swabbing of a surrounding subterranean formation while moving the service tool upwards. The reverse activated plug device may be useful in substantially stopping the flow of circulation fluids to the ball check such that the pressure during reverse-out operations may be increased without adversely affecting the formation, which would otherwise receive an increased amount of metered fluid through the weeping feature of the ball check and potentially fracture the formation. Moreover, the service tool may be configured to automatically reset itself for reuse.

Figure 1:
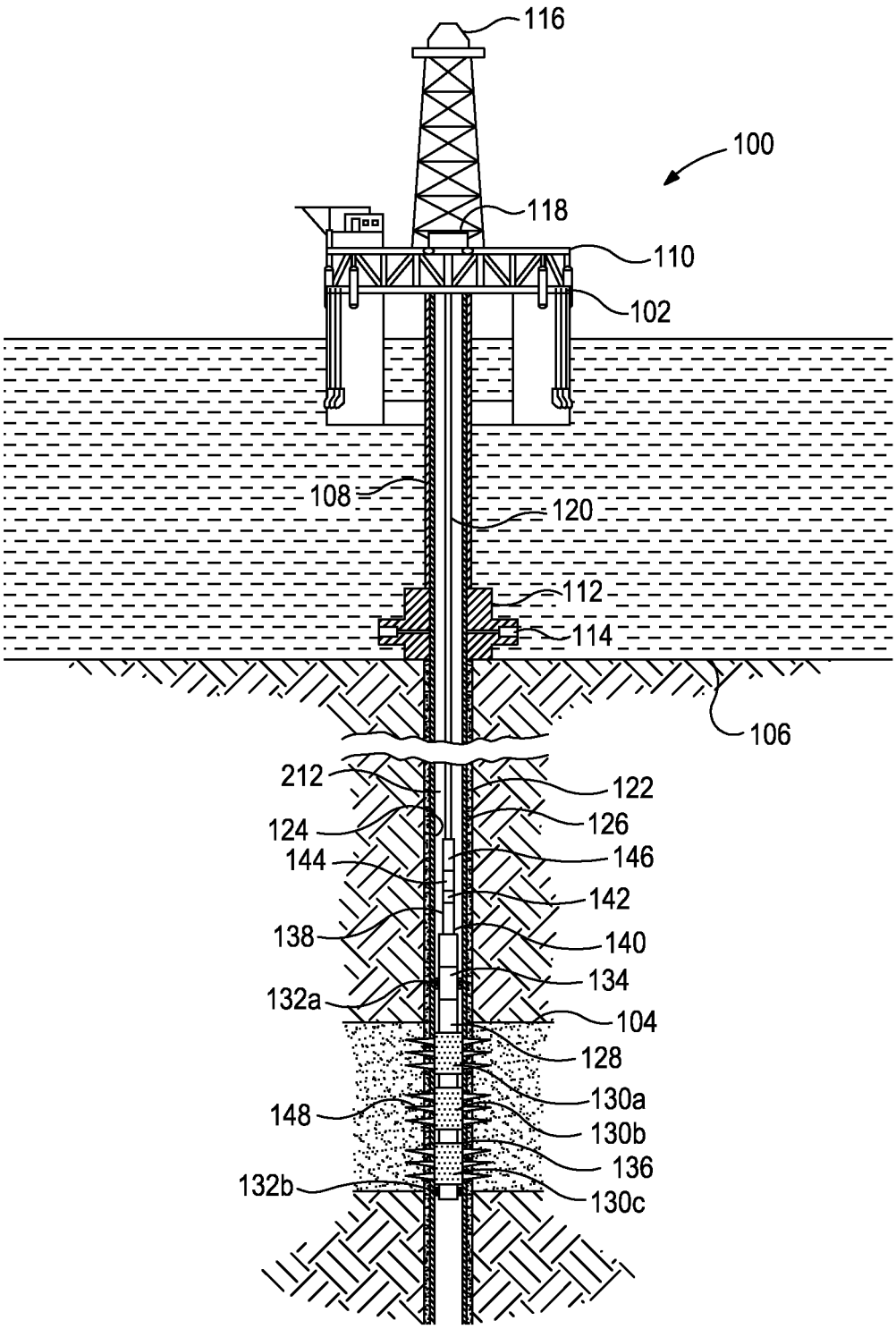
FIG. 1 illustrates an exemplary well system that employs one or more principles of the present disclosure, according to one or more embodiments.

Referring to FIG. 1, illustrated is an exemplary well system 100 that may employ one or more principles of the present disclosure, according to one or more embodiments. As illustrated, the well system 100 may include an offshore oil and gas platform 102 located above a submerged hydrocarbon-bearing formation 104 located below the sea floor 106. A subsea conduit or riser 108 extends from a deck 110 of the platform 102 to a wellhead installation 112 that may include one or more blowout preventers 114. The platform 102 may include a derrick 116 and a hoisting apparatus 118 for raising and lowering pipe strings, such as a work string 120. While the system 100 depicts the use of the offshore platform 102, it will be appreciated that the principles of the present disclosure are equally applicable to other types of oil and gas rigs, such as land-based drilling and production rigs, service rigs, and other oil and gas rigs located at any geographical location.

A wellbore 122 extends from the wellhead installation 112 and through various earth strata, including the formation 104. Casing 124 may be cemented within at least a portion of the wellbore 122 using cement 126. A completion string 128 is depicted in FIG. 1 as being installed within the casing 124 and may include one or more sand control devices, such as sand screens 130*a*, 130*b*, and 130*c* positioned adjacent the formation 104 between packers 132*a* and 132*b*. In some embodiments, the upper packer 132*a* may be part of a circulating valve 134.

When it is desired to gravel pack the annulus 136 defined about the sand control screens 130*a-c*, the work string 120 may be lowered through the casing 124 and at least partially into the completion string 128. The work string 120 may include a service tool 138 having a wash pipe 140, a reverse-out valve 142, a crossover tool 144, a setting tool 146, and other downhole tools known to those skilled in the art. Once the service tool 138 is properly positioned within completion string 128, the service tool 138 may be operated through its various positions to assure proper operation of the service tool 138. As illustrated, portions of the casing 124 and the wellbore 122 have been perforated to provide one or more perforations 148 that extend a distance into the surrounding formation 104 and provide fluid conductivity between the formation 104 and the annulus 136.

Even though FIG. 1 depicts a vertical well, it will be appreciated by those skilled in the art that the principles of the present disclosure are equally well-suited for use in deviated wells, inclined wells, or horizontal wells. Also, even though FIG. 1 depicts a cased wellbore 122, those skilled in the art will readily appreciate that the principles of the present disclosure are equally well-suited for use in open-hole completions. Additionally, even though FIG. 1 has been described with reference to a gravel packing operation, including a squeeze (i.e., fracking) operation, it should be noted by one skilled in the art that the principles of the present disclosure are equally well-suited for use in a variety of treatment operations where it is desirable to selectively allow and prevent circulation of fluids through a service tool 138 and prevent swabbing of the formation 104 due to axial movement of the service tool 138.

Figure 2:
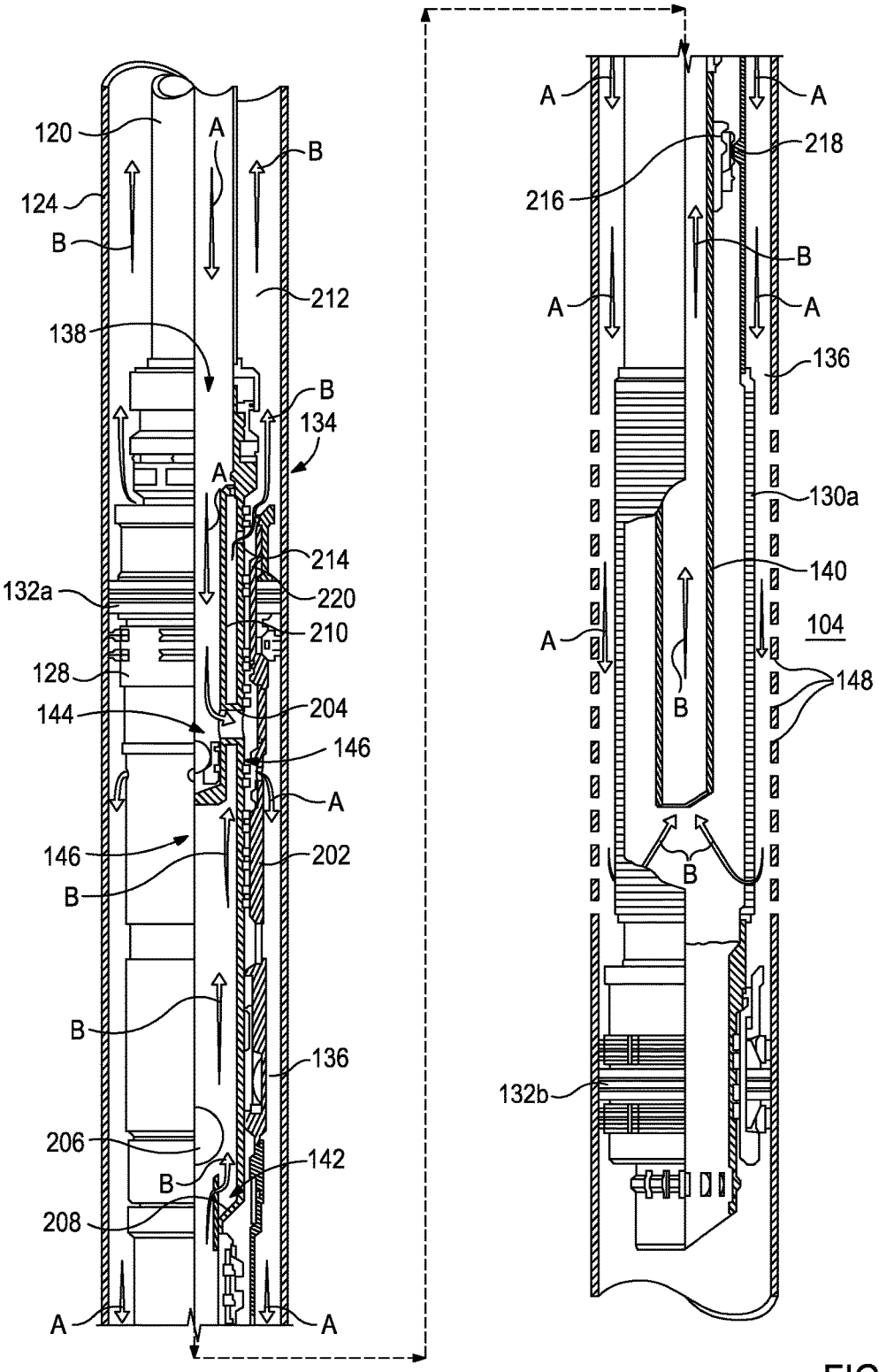
FIGS. 2-5 illustrate partial cross-sectional side views of the service tool of FIG. 1 positioned within the completion string of FIG. 1, according to one or more embodiments.
Figure 3:
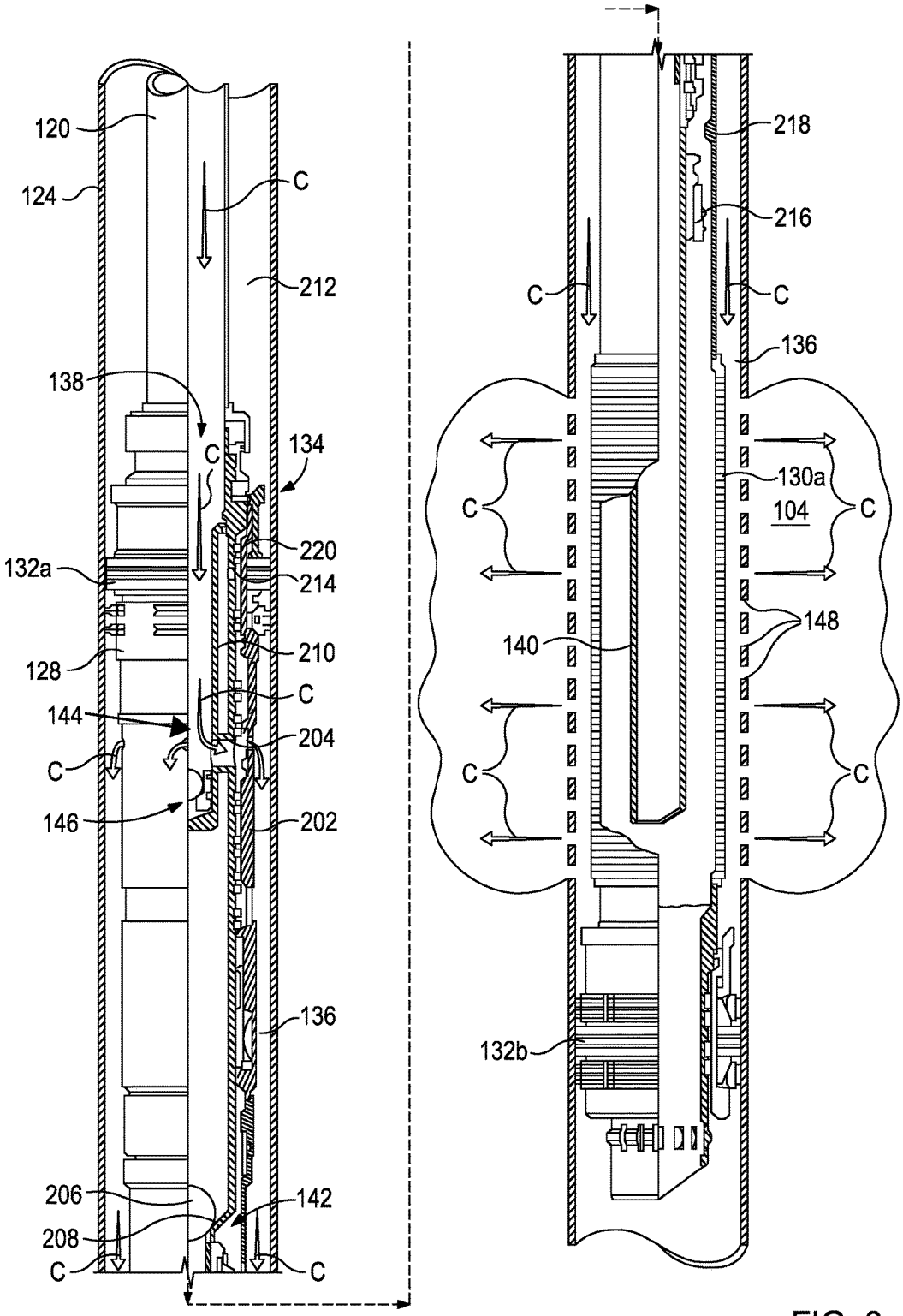
Figure 4:
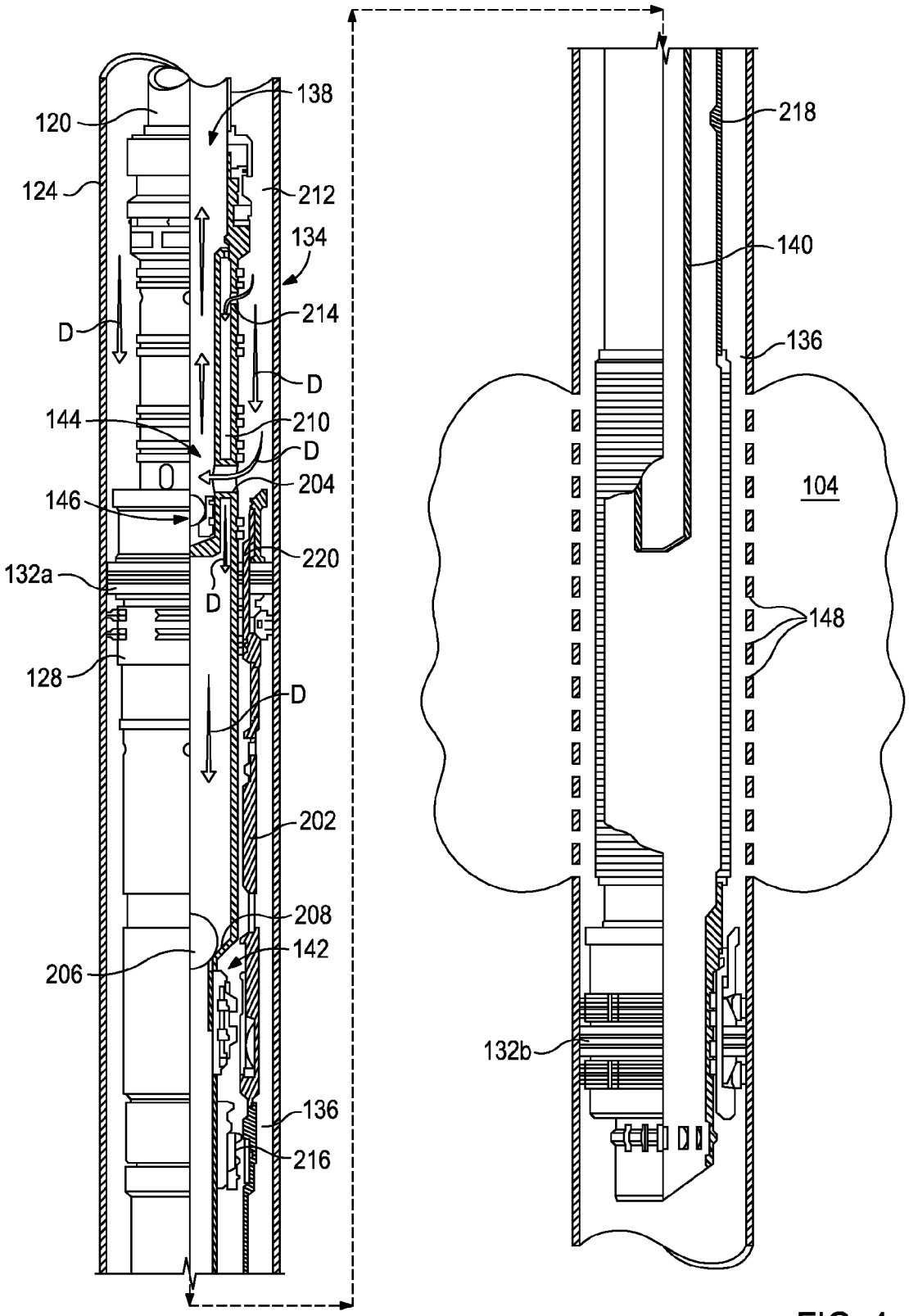
Figure 5:
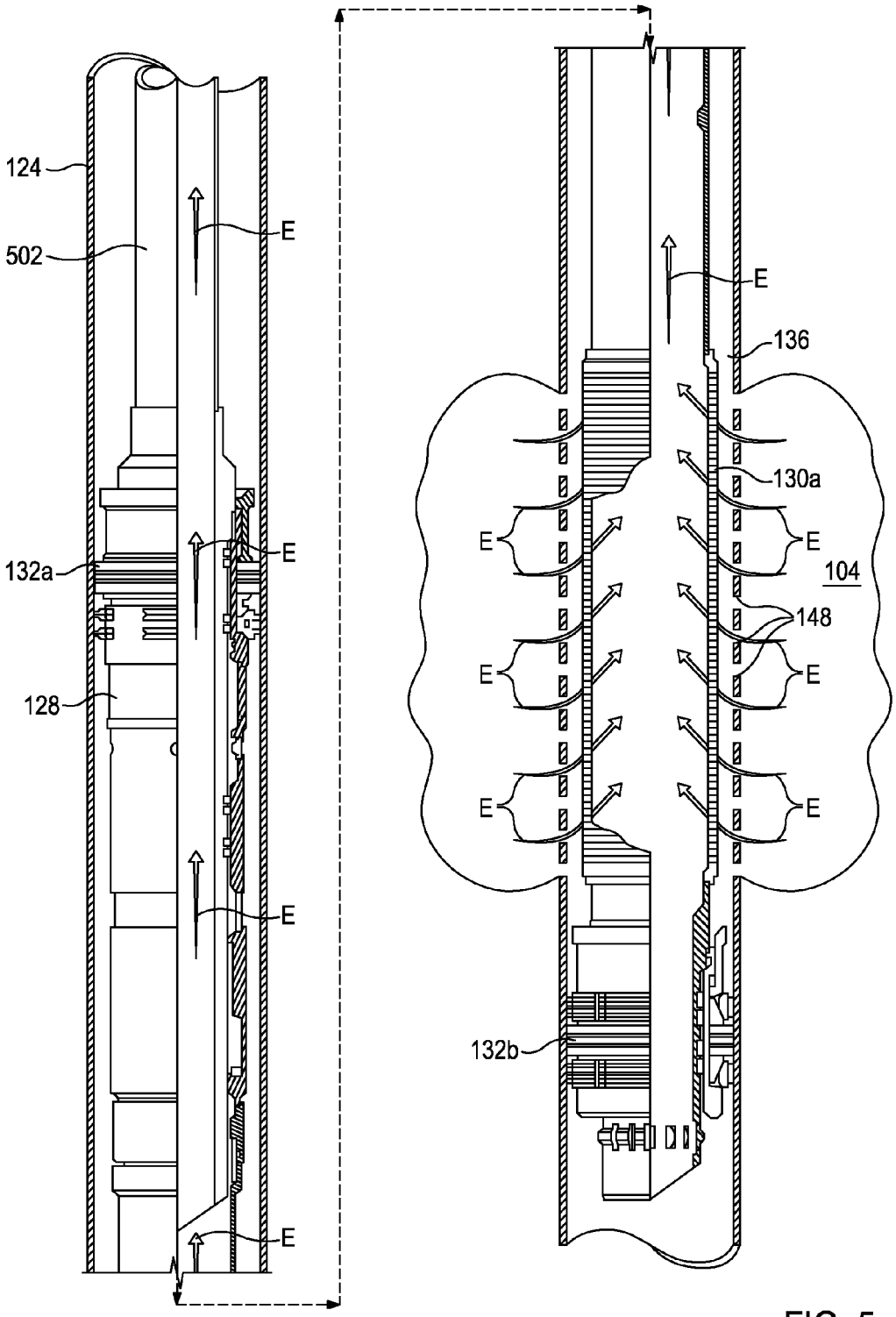

Referring now to FIGS. 2-5, with continued reference to FIG. 1, illustrated are partial cross-sectional side views of the service tool 138 positioned within the completion string 128, according to one or more embodiments. More particularly, FIGS. 2-5 depict successive axial sections of the service tool 138 and the completion string 128 while the service tool 138 is operated and otherwise axially manipulated relative to portions of the completion string 128. In FIG. 2, the service tool 138 is depicted in a circulating position, in FIG. 3 the service tool 138 is depicted in a squeeze position, and in FIG. 4 the service tool 138 is depicted in a reverse-out position. FIG. 5 depicts hydrocarbon production following removal of the service tool 138. It should be noted that only one sand screen 130*a* is depicted in FIGS. 2-5 for illustrative purposes in describing the features of the present disclosure. Those skilled in the art, however, will readily appreciate that more than one sand screen 130 (i.e., each of the sand screens 130*a-c* of FIG. 1) may be used, without departing from the scope of the disclosure.

Referring first to FIG. 2, a fluid slurry including a liquid carrier and a particulate material such as sand, gravel and/or proppants is pumped down the work string 120 to the service tool 138, as indicated by the arrows A, in order to undertake circulation operations. Once reaching the service tool 138, the fluid slurry A is able to exit the service tool 138 and enter the annulus 136 via the circulating valve 134. More particularly, a circulating sleeve 202 of the circulating valve 134 is depicted in its open position, thereby allowing the fluid slurry A to exit the crossover tool 144 via one or more circulation ports 204 provided by the crossover tool 144. As the fluid slurry A enters the annulus 136, at least a portion of the gravel in the fluid slurry is deposited within the annulus 136. Some of the liquid carrier and proppants, however, may enter the surrounding formation 104 through the one or more perforations 148 formed in the casing 124 and extending into the formation.

The remainder of the fluid carrier re-enters the service tool 138 via the sand control screen 130*a*, as indicated by arrows B. The fluid carrier B then enters the wash pipe 140 and is conveyed upward towards the reverse-out valve 142. As described in greater detail below, the reverse-out valve 142 may include a ball check 206 that, when the service tool 138 is in the circulating position, may be moved off a valve seat 208 such that the fluid carrier B may flow thereby and toward the crossover tool 144. At the crossover tool 144, the fluid carrier B may be conveyed to and through a return conduit 210 in fluid communication with the annulus 212 defined between the work string 120 and the wellbore 122 (FIG. 1) above the upper packer 132*a* via one or more return ports 214. After flowing out of the completion string 128 via the return ports 214, the fluid carrier B may return to the surface via the annulus 212. In the circulation position, the fluid slurry A is continuously pumped down the work string 120 until the annulus 136 around the sand control screen 130*a* is sufficiently filled with gravel, and the fluid carrier B is continuously returned to the surface via the annulus 212 for rehabilitation and recycling.

In FIG. 3, the service tool 138 has been moved axially with respect to the completion string 128 to the squeeze position. This may be accomplished by disengaging a weight down collet 216 from an indicator collar 218 defined on the inner surface of the completion string 128 and thereafter axially moving the service tool 138 relative to the completion string 128 until a seal 220 of the completion string 128 occludes the return ports 214. In the illustrated embodiment, the service tool 138 has been moved axially downwards in order to occlude the return ports 214 by placing a seal 220 inside the packer.

Once the service tool 138 is properly placed in the squeeze position, additional fluid slurry or another treatment fluid may then be pumped down the work string 120 and to the service tool, as indicated by the arrows C. Once in the service tool 138, the fluid slurry C may again pass through the crossover tool 144 and the circulating valve 134 via the circulation ports 204 and finally into the annulus 136 where the fluid slurry C enters the perforations 148 and serves to hydraulically fracture the formation 104. Since the return ports 214 are occluded by the seal 220 inside the packer mandrel, no return fluids enter the wash pipe 140 and flow towards the reverse-out valve 142. As a result, the ball check 206 is able to sit idly against the valve seat 208 using, for instance, gravitational forces acting thereon.

In FIG. 4, the service tool 138 has been moved into the reverse-out position to once again allow fluid returns to the surface. To accomplish this, the work string 120 and the service tool 138 are moved upwards with respect to the completion string 128, thereby exposing the return ports 214 and the circulation ports 204 to the annulus 212. In this configuration, a completion fluid may be pumped down the annulus 212 and into the service tool 138 through the crossover tool 144, as indicated by the arrows D. The completion fluid D flows into the work string 120 and returns to the surface via the work string 120 in order to reverse-out any gravel, proppant, or fluids that may remain within the work string 120.

During this process, a portion of the completion fluid D may also fluidly communicate with the reverse-out valve 142. More particularly, a portion of the completion fluid may enter the return conduit 210 via the return ports 214 and be conveyed toward the reverse-out valve 142 via the crossover tool 144. The fluid pressure exhibited by the completion fluid D forces the ball check 206 to seal against the valve seat 208, thereby creating a hard bottom that prevents the completion fluid D from traveling further downhole past the reverse-out valve 142. As will be discussed below, however, the ball check 206 may be configured to allow a metered amount of completion fluid D to pass therethrough in order to maintain hydrostatic pressure on the formation 104 via the wash pipe 140 and the sand screen 130*a*. As will be appreciated, allowing a metered amount of completion fluid D to pass through the reverse-out valve 142 prevents swabbing of the formation 104 even if the reverse-out valve 142 is moved upwardly relative to the completion string 128.

In FIG. 5, the service tool 138 has been removed from the completion string 128 and returned to the surface. In its place, production tubing 502 has been stung into and otherwise operatively coupled to the completion string 128. At this point, hydrocarbons may be produced from the formation 104, through the sand screen 130*a*, and conveyed to the surface via the production tubing 502, as indicated by arrows E.

Figure 6A:
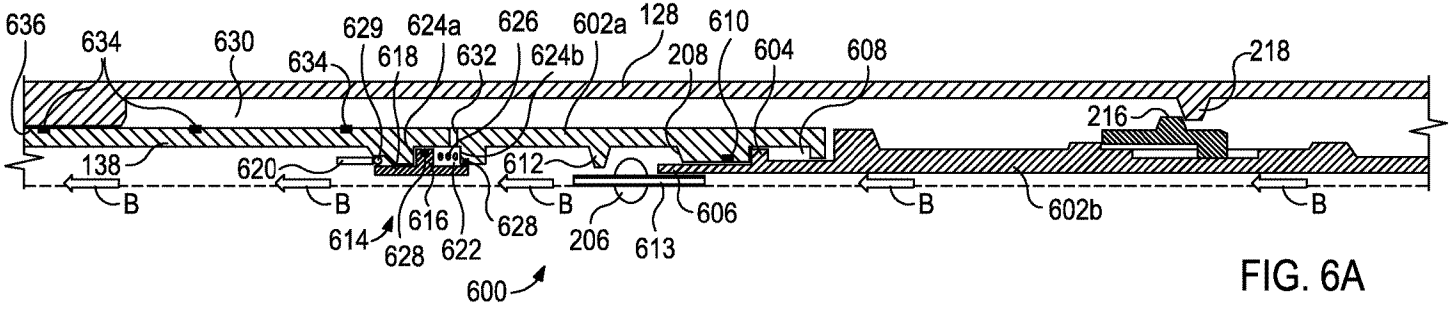
FIGS. 6A-6C illustrate progressive cross-sectional views of an exemplary reverse-out valve, according to one or more embodiments.
Figure 6B:
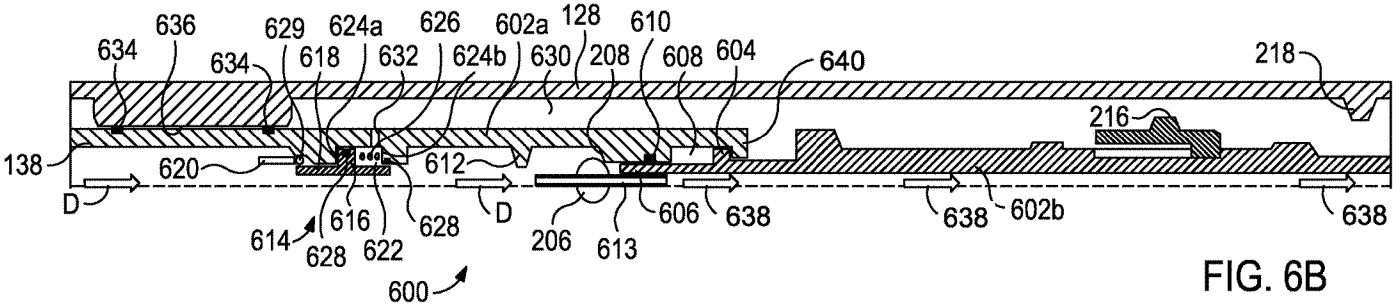
Figure 6C:
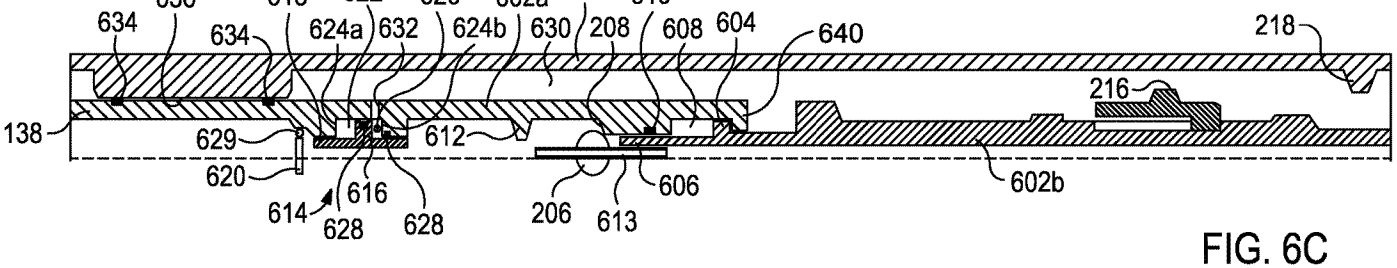

Referring now to FIGS. 6A-6C, illustrated are progressive cross-sectional views of an exemplary reverse-out valve 600, according to one or more embodiments. The reverse-out valve 600 may be similar in some respects to the reverse-out valve 142 of FIGS. 1-5, and may otherwise replace the reverse-out valve 142 during the circulation, squeeze, and reverse-out operations generally described above. Similar reference numerals used in FIGS. 6A-6C from prior figures indicate like elements that will not be described again in detail. In FIGS. 6A-6C, the reverse-out valve 600 forms part of the service tool 138 and is otherwise arranged within the completion string 128. FIG. 6A shows the reverse-out valve 600 during a circulation operation, FIG. 6B shows the reverse-out valve 600 while the service tool 138 is being moved to the reverse-out position and/or at the reverse-out position, and FIG. 6C shows the reverse-out valve 600 during a reverse-out operation.

As illustrated, the reverse-out valve 600 may include a first or upper mandrel 602*a* and a second or lower mandrel 602*b*. The weight down collet 216 may be arranged on the lower mandrel 602*b* and configured to axially support the service tool 138 when engaged with the indicator collar 218 defined on the inner wall of the completion string 128. The lower mandrel 602*b* may further include a radial shoulder 604 and a stem 606 that extends longitudinally upward from the radial shoulder 604. The upper mandrel 602*a* may define or provide an axial chamber 608 configured to receive the radial shoulder 604 of the lower mandrel 602*b* therein. The radial shoulder 604 may be able to axially translate within the axial chamber 608, and the interface between the upper and lower mandrels 602*a,b* may be sealed using one or more sealing elements 610 (one shown).

The ball check 206 may be generally arranged within the service tool 138 between a radial protrusion 612 defined on the inner wall of the service tool 138 and the valve seat 208. In some embodiments, the radial protrusion 612 may be castellated or otherwise include one or more flow paths used to allow fluid flow therethrough but simultaneously prevent the ball check 206 from moving past it. During weight-down on the service tool 138, such as is shown in FIG. 6A, the radial shoulder 604 may be arranged at the uphole end of the axial chamber 608, thereby extending the stem 606 past the valve seat 208 and otherwise separating the ball check 206 from the valve seat 208.

The ball check 206 may be ported or otherwise provide an axial fluid passageway 613. In some embodiments, the axial fluid passageway 613 may be a tubular structure known as a "weep tube" that extends through the ball check 206. In other embodiments, however, the axial fluid passageway 613 may be an orifice defined in the ball check valve 206 without departing from the scope of the disclosure. As will be described below, the fluid passageway 613 may be configured to allow a metered portion of fluid to pass therethrough in order to maintain hydrostatic pressure on the formation 104 (FIGS. 1-5) as the service tool 138 is moved axially within the completion string 128. Advantageously, fluid flow through the fluid passageway 613 may help mitigate or otherwise prevent damage to the formation 104 due to swabbing.

The reverse-out valve 600 may further include a reverse activated plug device 614 arranged uphole from the ball check 206. In the illustrated embodiment, the reverse activated plug device 614 may include a piston 616, a prop 618 extending longitudinally upward from the piston 616, and a closure device 620. The piston 616 may be movably arranged within a piston chamber 622 defined or otherwise provided by the upper mandrel 602*a*. The piston chamber 622 may include a first or upper end 624*a* and a second or lower end 624*b*. A biasing device 626, such as a helical compression spring or the like, may be arranged between the piston 616 and the lower end 624*b* of the piston chamber 622. In the illustrated embodiment, the biasing device 626 may be configured to urge the piston 616 toward the upper end 624*a* of the piston chamber 622. In other embodiments, however, the biasing device 626 may be configured to urge the piston 616 toward the lower end 624*b*, without departing from the scope of the disclosure.

One or more sealing devices 628 may interpose the piston 616 and the piston chamber 622 and/or the upper mandrel 602*a* such that a sealed interface results as the piston 616 axially translates within the piston chamber 622. One or more ports 632 (one shown) may be defined in the upper mandrel 602*a* in order to place the piston chamber 622 in fluid communication with an annulus 630 defined between the completion string 128 and the service tool 138. The annulus 630 may fluidly communicate with the annulus 136 (FIGS. 2-5) defined between the sand screen 130*a* and the casing 124 (FIGS. 2-5) or the formation 104 (FIGS. 2-5). As a result, the annulus 630 may generally exhibit the same fluid pressure as the annulus 136, and such fluid pressure may be exhibited within the piston chamber 622 via the ports 632.

When the piston 616 is generally arranged at the first end 624*a* of the piston chamber 622, as shown in FIGS. 6A and 6B, the prop 618 may be configured to hold the closure device 620 in an open position. As illustrated, the closure device 620 is in the form of a flapper but, as will be discussed in more detail below, the closure device 620 may take on several other forms, without departing from the scope of the disclosure. For the purposes of discussion of FIGS. 6A-6C, however, the closure device 620 will be referred to as "the flapper 620". The flapper 620 may include a torsion spring 629 or the like that urges the flapper 620 toward a closed position (FIG. 6C) when not engaged or otherwise prevented from closing by the prop 618.

In FIG. 6A, the completion string 128 and the service tool 138 are in the circulation position, as generally described above with reference to FIG. 2, and the reverse activated plug device 614 is in an open position. As described above with reference to FIG. 2, some of the liquid carrier or fluid B from the fluid slurry provided to the service tool 138 may re-enter the service tool 138 at the sand screens (not shown) and be conveyed toward the reverse-out valve 142. In FIG. 6A, the fluid B is able to flow past the ball check 206, which is held off the valve seat 208 with the stem 606.

Moreover, during circulation the reverse activated plug device 614 may also be held in an open position. More particularly, the fluid pressure within the service tool 138 and the annulus 630 is generally balanced during circulation operations, thereby allowing the biasing device 622 to urge the piston 616 against the first end 624*a* of the piston chamber 622 as designed. As a result, the flapper 620 is propped open by the prop 618, and thereby holds the reverse activated plug device 614 in the open position and allows the fluid B to bypass the reverse activated plug device 614 and proceed upward within the service tool 138.

In FIG. 6B, the service tool 138 is either being moved uphole or "picked up" in the upwards direction with respect to the completion string 128 or is otherwise arranged for reverse-out operations. As the service tool 138 is moved uphole, one or more sealing elements 634 provided on the upper mandrel 602*a* may be moved into sealing engagement with a seal bore 636 of the completion string 128. As will be appreciated, the sealing elements 634 may equally be arranged on the seal bore 636, without departing from the scope of the disclosure. Moreover, as the service tool 138 is moved uphole, the radial shoulder 604 of the lower mandrel 602*b* engages an end wall 640 provided on the lower end of the axial chamber 608 and thereby separates the weight down collet 216 from the indicator collar 218. Engaging the radial shoulder on the end wall 640 also lowers the stem 606 with respect to the valve seat 208, thereby allowing the ball check 206 to engage the valve seat 208.

As the service tool 138 is moved uphole, a portion of the fluid 638 within the service tool 138 may be able to traverse the ball check 206 through the fluid passageway 613 and flow toward the formation 104 (FIGS. 1-5). As can be appreciated, some wells that are being gravel packed do not exhibit large amounts of pressure and the corresponding formations 104 are oftentimes lightly consolidated. As a result, well operators must maintain fluid pressure on the formation 104 at all times or otherwise risk damage to the integrity of the formation 104. Advantageously, the fluid passageway 613 allows the formation 104 to receive or eject fluids 636 through the ball check 206 when needed in order to maintain the integrity of the formation 104. Without the fluid passageway 613, a vacuum or overpressure could result at or near the formation 104 when the service tool 138 is moved axially (in either axial direction), thereby potentially resulting in significant damage to the formation 104, including undesirable swabbing thereof.

Accordingly, the service tool 138 and corresponding reverse-out valve 600 can be moved upwardly or downwardly within the completion string 128 as many times as desired by the well operator, depending upon the desired treatment regimen. Importantly, this upward and downward movement will not cause swabbing of the formation 104 as the fluids are able to bypass the ball check 206 at a metered flow rate via the fluid passageway 613.

As the service tool 138 is moved with respect to the completion string 128, the reverse activated plug device 614 remains in its open position. During such movement, the fluid pressure within the service tool 138 may exceed that of the annulus 630, but the biasing device 626 may be configured to urge the piston 616 against the first end 624*a* of the piston chamber 622 until a predetermined pressure threshold is attained. More particularly, the biasing device 626 may be sized or otherwise rated so that the piston 616 will be unable to move toward the second end 624*b* and thereby compress the biasing device 626 until a predetermined pressure differential between the interior of the service tool 138 and the annulus 630 is achieved. Once the predetermined pressure differential is achieved, however, the piston 616 is able to compress the biasing device 626 and move toward the second end 624*b* of the piston chamber 622.

Still referring to FIG. 6B, once the service tool 138 is properly positioned for reverse-out operations, the completion fluid D may be introduced into the service tool 138 in order to reverse-out any gravel, proppant, or fluids remaining within the work string 120, as generally described above with reference to FIG. 4. A portion of the completion fluid D may interact with the reverse-out valve 600, and the resulting fluid pressure forces the ball check 206 to seal against the valve seat 208, thereby creating a hard bottom that largely prevents the completion fluid D from traveling further downhole. As the ball check 206 seals against the valve seat 208, a metered amount of the fluid 638 is able to flow through the fluid passageway 613 to maintain hydrostatic pressure on the formation 104. As the fluid pressure of the completion fluid D increases, the weep rate or flow rate of the fluid 638 through the fluid passageway 613 correspondingly increases. As will be appreciated, the size (i.e., diameter) and length of the fluid passageway 613 may be optimized in order to alter the flow rate through the fluid passageway 613 and otherwise provide a required or desired amount of fluid 638 to the formation 104 while moving the service tool 138 and to restrict the amount of fluid to the formation 104 during reverse out.

In FIG. 6C, the pressure of the completion fluid D has increased to or past the pressure threshold or to a point where the predetermined pressure differential between the interior of the service tool 138 and the annulus 630 has been reached. As a result, the reverse activated plug device 614 may be actuated to close off the interior of the service tool 138. More particularly, the pressure differential may overcome the spring force of the biasing device 626, thereby allowing the piston 616 to compress the biasing device 626 as it moves toward the second end 624*b*.

As the piston 616 moves to the second end 624*b* of the piston chamber 622, the prop 618 moves out of radial engagement with the flapper 620, thereby allowing the torsion spring 629 to pivot the flapper 620 to its closed position. With the reverse activated plug device 614 in its closed position, the reverse-out fluid pressures within the service tool 138 can be increased and otherwise maxed out for greater reverse-circulation effectiveness. The completion fluid D (FIG. 6B) will be unable to bypass the reverse activated plug device 614 in the closed position, thereby preventing increased-pressure fluids from potentially bypassing the ball check 206 via the fluid passageway 613 and potentially damaging the formation 104 (FIGS. 1-5). The elevated fluid pressures within the service tool 138 may be configured to maintain the flapper 620 closed and isolate the formation 104 from the increased reverse-out pressures.

The reverse activated plug device 614 may be configured to autonomously return to the open position once the pressure within the service tool 138 falls below the predetermined pressure threshold or differential. At that point, the biasing device 626 again urges the piston 616 back toward the first end 624*a* of the piston chamber 622 and the prop 618 is correspondingly moved axially to force the flapper 620 back to its open configuration.

As will be appreciated, the addition of the reverse activated plug device 614 eliminates the potential for pressurized fluid 638 (FIG. 6B) to reach the formation 104 (FIGS. 1-5) during reverse-out operations. Advantageously, the internal pressure of the service tool 138 autonomously shuts off any potential fluid flow further down the service tool 138, such as to the ball check 206 or to the formation 104. During treating, the service tool 138 is in a fully open configuration to communicate fluid with the annulus 212 (FIGS. 1-5). While moving the service tool 138, the fluid passageway 613 helps to maintain hydrostatic pressure on the formation 104 while also preventing swabbing of the formation 104. Moreover, the service tool 138 may be configured to automatically reset itself for reuse.

Those skilled in the art will readily appreciate that variations of the reverse activated plug device 614 may be used in the reverse-out valve 600, without departing from the scope of the disclosure. For example, it is further contemplated herein to replace the flapper 620 (i.e., the closure device 620) with various other types of closure devices that essentially serve the same purpose as the flapper 620 in preventing fluid communication past the reverse activated plug device 614 during reverse-out operations.

Figure 6D:
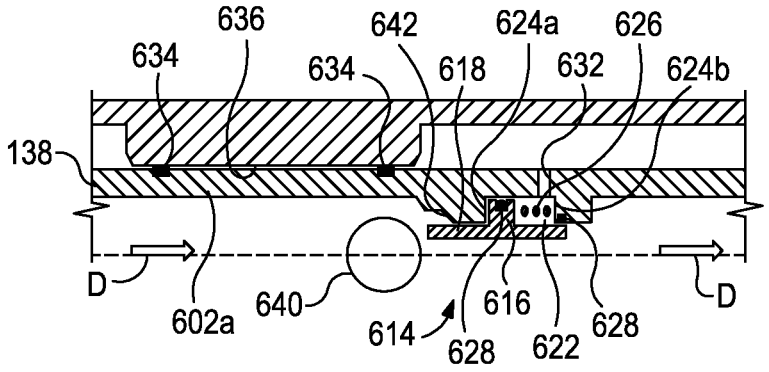
FIGS. 6D-6F illustrate cross-sectional view of alternative embodiments of the reverse activated plug device of FIGS. 6A-6C, according to one or more embodiments.
Figure 6E:
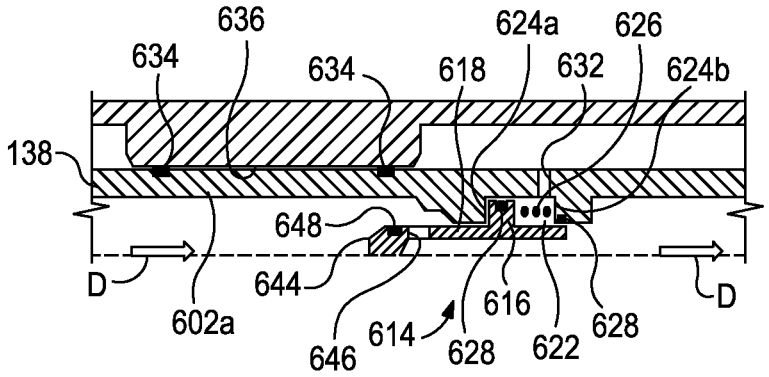
Figure 6F:
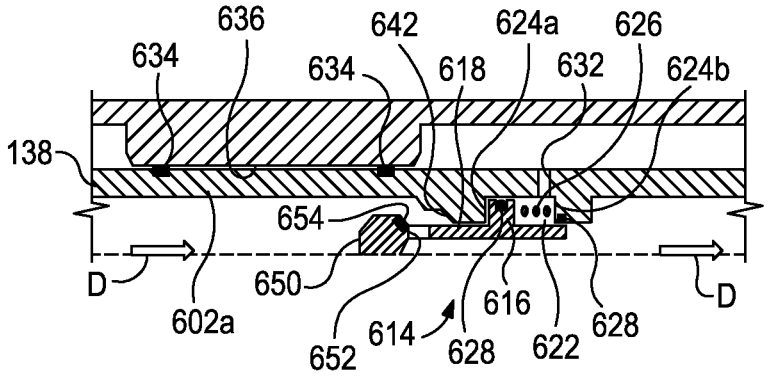

For example, referring now to FIGS. 6D-6F, illustrated are alternative embodiments of the reverse activated plug device 614 of FIGS. 6A-6C, according to one or more embodiments. In each of FIGS. 6D-6F, the closure device 620 of FIGS. 6A-6C is replaced with another mechanism or device configured to provide a sealed or plugged location within the service tool 138 above the ball check 206 such that the completion fluid D will be unable to bypass the reverse activated plug device 614. As with the embodiment discussed in FIGS. 6A-6F, the reverse activated plug device 614 in each of the following embodiments may be re-opened by reducing the pressure within the service tool 138 below the predetermined pressure threshold or differential, as generally described above.

In FIG. 6D, the reverse activated plug device 614 may include a ball 640 that is held off a ball seat 642 while in the open position by the prop 618 of the piston 616. In such embodiments, the proximal end of the prop 618 may be castellated or otherwise have one or more flow channels (not shown) defined therein such that the completion fluid D may flow therethrough when the plug ball 640 is forced against it. In operation, the service tool 138 may be moved and otherwise properly positioned for reverse-out operations, as described above, and the completion fluid D may be introduced into the service tool 138. Once the pressure of the completion fluid D within the service tool 138 has surpassed the predetermined pressure differential between the interior of the service tool 138 and the annulus 630, the reverse activated plug device 614 may be actuated, thereby allowing the piston 616 to compress the biasing device 626 as it moves toward the second end 624*b*. As the piston 616 moves to the second end 624*b* of the piston chamber 622, the prop 618 moves out of engagement with the ball 640, thereby allowing the ball 640 to locate and sealingly engage the ball seat 642.

In FIG. 6E, the reverse activated plug device 614 may include a ported end 644 extending from or otherwise forming part of the prop 618. The ported end 644 may include a one or more flow ports 646 (one shown) and a sealing element 648. The flow ports 646 may be configured to allow the completion fluid D to bypass the reverse activated plug device 614 when the reverse activated plug device 614 is in its open position. Upon moving the reverse activated plug device 614 to its closed position, however, the flow ports 646 may become occluded and thereby prevent the completion fluid D from bypassing the reverse activated plug device 614. More particularly, once the pressure of the completion fluid D within the service tool 138 surpasses the predetermined pressure differential between the interior of the service tool 138 and the annulus 630, the piston 616 may then compress the biasing device 626 as it moves toward the second end 624*b*. The prop 618 and associated ported end 644 may correspondingly move axially and simultaneously bring the sealing element 648 into sealing engagement with the inner wall of the upper mandrel 602*a*, thereby also occluding the ports 646 such that the completion fluid D is substantially prevented from bypassing the reverse activated plug device 614.

In FIG. 6F, the reverse activated plug device 614 may include a ported shoulder 650 extending from or otherwise forming part of the prop 618. The ported shoulder 650 may include one or more flow ports 652 (one shown) and a sealing surface 654. The flow ports 652 may be configured to allow the completion fluid D to bypass the reverse activated plug device 614 when the reverse activated plug device 614 is in its open position. Upon moving the reverse activated plug device 614 to its closed position, however, the flow ports 652 may become occluded and thereby prevent the completion fluid D from bypassing the reverse activated plug device 614. More particularly, once the pressure of the completion fluid D within the service tool 138 surpasses the predetermined pressure differential between the interior of the service tool 138 and the annulus 630, the piston 616 compresses the biasing device 626 as it moves toward the second end 624*b*. The prop 618 and associated ported shoulder 650 may correspondingly move axially and simultaneously bring the sealing surface 654 into sealing engagement with the seat 642, thereby also occluding the ports 652 such that the completion fluid D is substantially prevented from bypassing the reverse activated plug device 614.

In any of the embodiments of FIGS. 6D-6F, upon decreasing the fluid pressure within the service tool 138 below the predetermined pressure threshold or differential, the reverse activated plug device 614 may autonomously return to the open position where the biasing device 626 again urges the piston 616 back toward the first end 624*a* of the piston chamber 622 and the prop 618 correspondingly moves axially. As will be appreciated, several additional alternative embodiments to the reverse activated plug device 614 may be employed, without departing from the scope of the disclosure. Those skilled in the art will readily recognize that the embodiments depicted in FIGS. 6D-6F are shown merely for illustrative purposes in further describing the limits of the present disclosure.

Figure 7A:
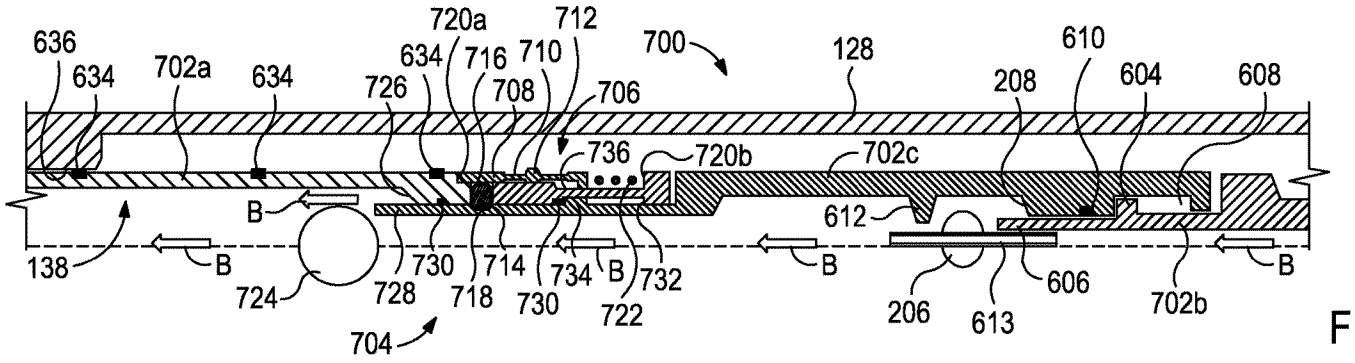
FIGS. 7A-7C illustrate progressive cross-sectional views of another exemplary reverse-out valve, according to one or more embodiments.
Figure 7B:
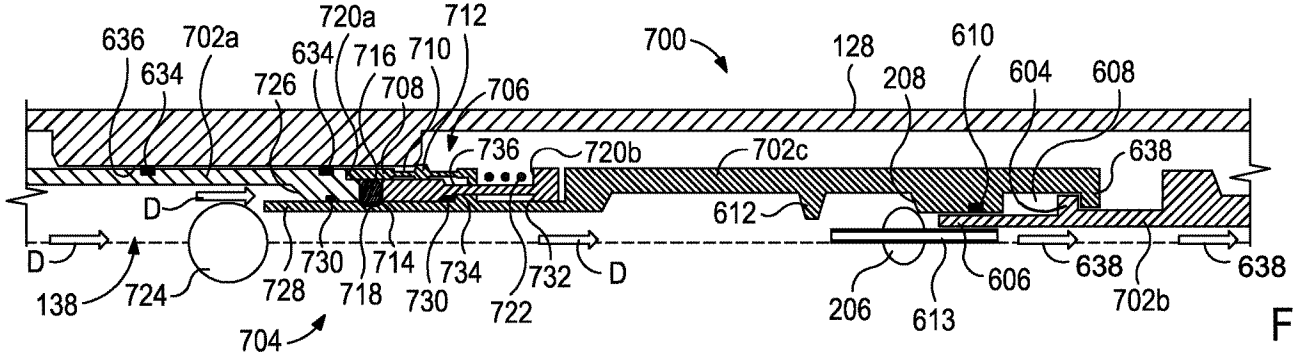
Figure 7C:
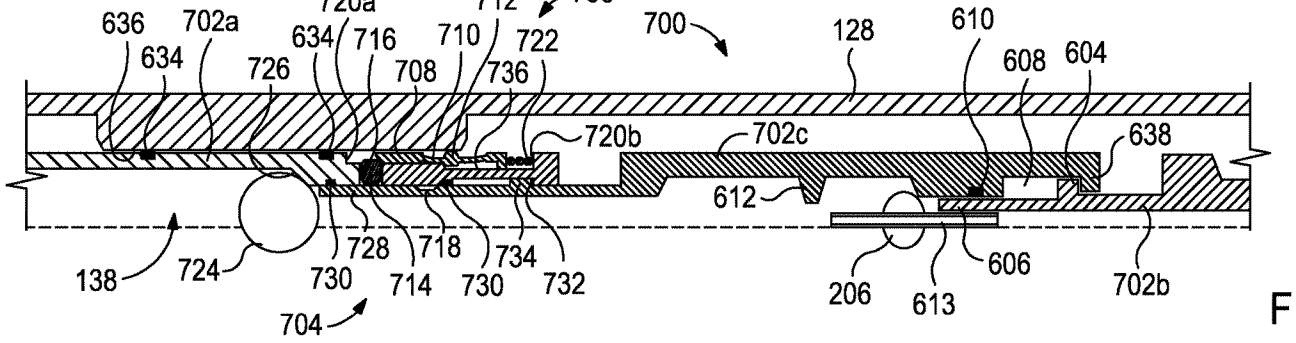

Referring now to FIGS. 7A-7C, illustrated are progressive cross-sectional views of another exemplary reverse-out valve 700, according to one or more embodiments. The reverse-out valve 700 may be similar in some respects to the reverse-out valve 600 of FIGS. 6A-6C and therefore may be best understood with reference thereto, where like numerals indicate like elements not described again in detail. Similar to the reverse-out valve 600 of FIGS. 6A-6C, the reverse-out valve 700 may replace the reverse-out valve 142 of FIGS. 1-5 during the circulation, squeeze, and reverse-out operations generally described above. The reverse-out valve 700 again forms part of the service tool 138 and is otherwise arranged within the completion string 128. FIG. 7A shows the reverse-out valve 700 during circulation operations, FIG. 7B shows the reverse-out valve 700 while the service tool 138 is being moved to the reverse-out position and/or positioned at the reverse-out position, and FIG. 7C shows the reverse-out valve 700 during reverse-out operations.

As illustrated, the reverse-out valve 700 may include an upper mandrel 702*a*, a lower mandrel 702*b*, and an intermediate mandrel 702*c* that interposes the upper and lower mandrels 702*a,b*. The intermediate and lower mandrels 702*c* and 702*b* may be similar in some respects to the upper and lower mandrels 602*a,b*, respectively, of FIGS. 6A-6C. More particularly, the lower mandrel 702*b* may include or otherwise provide the radial shoulder 604 and the stem 606, and the intermediate mandrel 702*c* may define or otherwise provide the axial chamber 608 configured to receive the radial shoulder 604. Moreover, the intermediate mandrel 702*c* may further provide the valve seat 208 and the radial protrusion 612 defined on the inner wall of the service tool 138.

The reverse-out valve 700 may include the ball check 206, which operates in substantially the same way as described above with reference to the reverse-out valve 600. Again, the ball check 206 may include or otherwise have defined therein the fluid passageway 613 used to maintain hydrostatic pressure on the formation 104 (FIGS. 1-5) as the service tool 138 is moved within the completion string 128, and thereby preventing undesirable swabbing of the formation 104.

The reverse-out valve 700 may further include a reverse activated plug device 704 arranged uphole from the ball check 206. Similar to the reverse activated plug device 614 of FIGS. 6A-6C, the reverse activated plug device 704 may be configured to eliminate the potential for pressurized fluid to reach the formation 104 (FIGS. 1-5) during full reverse-out operations and otherwise shut off any potential fluid flow further down the service tool 138, such as to the ball check 206. As illustrated, the reverse activated plug device 704 may include a collet 706 having a cover portion 708 and a plurality of fingers 710 (one shown) extending axially from the cover portion 708. The collet 706 may be generally arranged about the upper mandrel 702*a* and each finger 710 may include or otherwise have defined thereon a collet protrusion 712.

The reverse activated plug device 704 may further include a plurality of dogs 714 movably arranged within a corresponding plurality of windows 716 defined in the upper mandrel 702*a*. Similar to the reverse activated plug device 614 of FIGS. 6A-6C, the reverse activated plug device 704 may be movable between an open position and a closed position. In the open position, as shown in FIGS. 7A and 7B, the dogs 714 may be disposed within a groove 718 defined in the intermediate mandrel 702*c* and may be maintained therein with the cover portion 708 being extended radially over each window 716. More specifically, in the open position, the cover portion 708 may be urged against or toward an upper shoulder 720*a* of the upper mandrel 702*a* with a biasing device 722, and thereby be moved over the windows 716 and otherwise prevent the dogs 714 from exiting the groove 718. The biasing device 722 may be a helical compression spring or the like and may be arranged between the collet 706 and a lower shoulder 720*b* of the upper mandrel 702*a*.

The reverse activated plug device 704 may further include a plug device ball 724 and a plug seat 726 defined on the interior of the upper mandrel 702*a*. The plug device ball 724 may be configured to engage or otherwise seal against the plug seat 726 when not obstructed by a proximal end 728 of the intermediate mandrel 702*c*. Once the intermediate mandrel 702*c* moves axially downward with respect to the upper mandrel 702*a*, as shown in FIG. 7C, the proximal end 728 exposes the plug seat 726 and thereby allows the plug device ball 724 to engage and seal against the plug seat 726. One or more sealing elements 730 may interpose the upper and intermediate mandrels 702*a,c* such that a sealed interface results as the reverse activated plug device 704 moves between the open and closed positions.

In FIG. 7A, the completion string 128 and the service tool 138 are in the circulation position, as generally described above with reference to FIG. 2, and the reverse activated plug device 704 is in its open position. Some of the liquid carrier or fluid B from the fluid slurry provided to the service tool 138 re-enters the service tool 138 and is conveyed toward the reverse-out valve 700, as generally described above. In FIG. 7A, the fluid B is able to flow past the ball check 206, which is held off the valve seat 208 with the stem 606. The fluid B is also able to flow past the plug device ball 724 of the reverse activated plug device 704, which is also held in its open position by the dogs 714 being arranged in the groove 718 and held in place by the cover 708 such that the proximal end 728 of the intermediate mandrel 702*c* extends upwards past the plug seat 726.

In FIG. 7B, the service tool 138 is depicted as being moved in the upwards direction (i.e., uphole) with respect to the completion string 128 or otherwise in a partial reverse-out position. As the service tool 138 is moved uphole, the sealing elements 634 provided on the upper mandrel 702*a* may be moved into sealing engagement with the seal bore 636 of the completion string 128. Moreover, as the service tool 138 is moved uphole, the radial shoulder 604 of the lower mandrel 602*b* engages the end wall 640 of the axial chamber 608, thereby lowering the stem 606 with respect to the valve seat 208 and allowing the ball check 206 to engage and seal against the valve seat 208.

Moreover, as the service tool 138 is moved uphole, or otherwise while the service tool 138 is in the partial reverse-out position, the collet protrusions 712 of the reverse activated plug device 704 will eventually engage the seal bore 636. In such a configuration, reverse-out operations may commence by introducing the completion fluid D into the service tool 138 in order to reverse-out any gravel, proppant, or fluids remaining within the work string 120, as generally described above with reference to FIG. 4. Some completion fluid D may flow around the plug device ball 724 of the reverse activated plug device 704, which is held in its open position by the proximal end 728 of the intermediate mandrel 702*c*. It should be noted that the proximal end 728 might be castellated or otherwise have one or more flow channels (not shown) defined therein such that the completion fluid D may flow therethrough when the plug device ball 724 is forced against it. Accordingly, a portion of the fluid D within the service tool 138 may be able to bypass the plug device ball 724 and subsequently traverse the ball check 206 via the fluid passageway 613 as fluid 638.

The completion fluid D that bypasses the plug device ball 724 may force the ball check 206 to seal against the valve seat 208, thereby creating a hard bottom that largely prevents the completion fluid D from traveling further downhole. As described above, the ball check 206 seals against the valve seat 208, but a metered amount of the fluid 638 is able to flow through the fluid passageway 613 to maintain hydrostatic pressure on the formation 104. Again, the fluid passageway 613 allows the formation 104 (FIGS. 1-5) to receive or eject fluids 636 through the ball check 206 when needed in order to maintain the integrity of the formation 104 and prevent undesirable swabbing thereof.

Referring to FIG. 7C, the service tool 138 is shown as fully actuated to a full reverse-out position, where the reverse activated plug device 704 is placed in its closed position. More particularly, once the collet protrusions 712 engage the seal bore 636, the upper mandrel 702*a* may be able to continue moving upward, thereby compressing the biasing device 722 between the lower shoulder 720*b* and the collet 706. With the dogs 714 generally arranged within the groove 718, the upper mandrel 702*a* is prevented from moving with respect to the intermediate mandrel 702*c*. As the biasing device 722 is compressed, however, the cover portion 708 may be moved out of axial engagement with the upper shoulder 720*a* and therefore out of radial engagement with the dogs 714. As a result, the dogs 714 may then be able to radially expand within their respective windows 716 and otherwise release the upper mandrel 702*a* with respect to the intermediate mandrel 702*c*. Beveled or chamfered edges of the dogs 714 and/or the groove 718 may help facilitate ease of radial movement of the dogs 714 out of the groove 718.

Once the biasing device 722 is compressed fully and otherwise bottoms out against the lower shoulder 720*b*, the upper mandrel 702*a* may continue to move upward and an end wall 732 of the upper mandrel 702*a* may be brought into axial contact with a radial protrusion 734 of the intermediate mandrel 702*c*. Once the end wall 732 and the radial protrusion 734 are axially engaged, continued axial force applied on the upper mandrel 702*a* may force the collet protrusions 712 to flex radially inward and into a reduced-diameter portion 736 defined in the upper mandrel 702*a* between the upper and lower shoulders 720*a,b*. Beveled or chamfered edges or ends of one or more of the collet protrusions 712, the seal bore 636, and the reduced-diameter portion 736 may help facilitate ease of radial movement of the collet protrusions 712 into the reduced-diameter portion 736. Once flexed into the reduced-diameter portion 736, the collet protrusions 712 may be able to slide or move beneath the seal bore 636 as the service tool 138 continues moving upward.

With the reverse activated plug device 704 placed in its closed position, the proximal end 728 of the intermediate mandrel 702*c* is moved axially downward, thereby allowing the plug device ball 724 to engage and seal against the plug seat 726. In this position, the reverse-out fluid pressures within the service tool 138 may be maxed out for greatest reverse-circulation effectiveness. More specifically, with the plug device ball 724 sealingly engaged with the plug seat 726, the completion fluid D (FIG. 7B) will be unable to bypass the reverse activated plug device 704, thereby isolating the formation 104 and otherwise preventing increased-pressure fluids from bypassing the ball check 206 via the fluid passageway 613 and potentially damaging the formation 104 (FIGS. 1-5).

The reverse activated plug device 704 may be moved back to its open position by placing an axial compression load on the upper mandrel 702*a*, which will separate the end wall 732 and the radial protrusion 734 and otherwise allow the dogs 714 to seat themselves again within the groove 718. The proximal end 728 of the intermediate mandrel 702*c* also extends back upwards, thereby forcing the plug device ball 724 off the plug seat 726. Continued axial compression load may move the collet protrusions 712 out of radial engagement with the seal bore 636, thereby allowing the spring force built up in the biasing device 722 to urge the collet 706 back against the upper shoulder 720*a*. In this position, the cover portion 708 once again extends over the windows 716 and thereby maintains the dogs 714 within the groove 718.

Embodiments disclosed herein include:

A. A reverse-out valve that includes an upper mandrel, a lower mandrel movable with respect to the upper mandrel, and a reverse activated plug device arranged on the upper mandrel and including a piston movably arranged within a piston chamber defined by the upper mandrel and a prop that extends longitudinally from the piston, wherein the piston chamber includes a first end and a second end, the reverse activated plug device further including a closure device movable between an open position and a closed position, wherein, when in the open position, the piston is arranged at the first end and the prop holds the closure device open such that a reverse-circulation fluid is able to bypass the reverse activated plug device, and wherein, when in the closed position, the piston is arranged at the second end and the prop is moved to allow the closure device to close and thereby prevent the reverse-circulation fluid from bypassing the reverse activated plug device.

B. A system that includes a completion string disposable within a wellbore and including one or more sand screens arranged adjacent a subterranean formation, a service tool configured to be arranged within the completion string such that an annulus is formed therebetween and including an upper mandrel and a lower mandrel movable with respect to the upper mandrel, and a reverse activated plug device arranged on the service tool and comprising a piston movably arranged within a piston chamber defined by the upper mandrel and a prop that extends longitudinally from the piston, wherein the piston chamber includes a first end and a second end, the reverse activated plug device further including a closure device movable between an open position and a closed position, wherein, when in the open position, the piston is arranged at the first end and the prop holds the closure device open such that a reverse-circulation fluid is able to bypass the reverse activated plug device, and wherein, when in the closed position, the piston is arranged at the second end and the prop is moved to allow the closure device to close and thereby prevent the reverse-circulation fluid from bypassing the reverse activated plug device.

C. A method that includes arranging a completion string within a wellbore providing one or more zones of interest within a subterranean formation, the completion string including one or more sand screens arranged adjacent the one or more zones of interest, introducing a service tool at least partially into the completion string and thereby forming an annulus therebetween, the service tool including an upper mandrel and a lower mandrel movable with respect to the upper mandrel, conveying a reverse-out fluid into the service tool and past a reverse activated plug device arranged on the service tool, the reverse activated plug device comprising a piston movably arranged within a piston chamber defined by the upper mandrel, a prop that extends longitudinally from the piston, and a closure device, increasing a pressure of the reverse-out fluid within the service tool and thereby moving the closure device from an open position, where the prop holds the closure device open, to a closed position, where the prop is moved to allow the closure device to close and thereby prevent the reverse-circulation fluid from bypassing the reverse activated plug device.

Each of embodiments A, B, and C may have one or more of the following additional elements in any combination: Element 1: wherein the reverse activated plug device further comprises a biasing device arranged between the piston and the second end and configured to urge the piston toward the first end, and one or more ports defined in the upper mandrel that place the piston chamber in fluid communication with an exterior of the reverse-out valve, wherein, when a predetermined pressure differential between the exterior and an interior of the reverse-out valve is achieved, the piston moves toward the second end of the piston chamber and compresses the biasing device. Element 2: wherein the predetermined pressure differential is achieved when the reverse-circulation fluid within the interior of the reverse-out valve reaches a pressure threshold. Element 3: wherein decreasing a pressure within the interior of the reverse-out valve below the predetermined pressure differential allows the biasing device to move the piston toward the first end of the piston chamber and correspondingly move the prop such that the closure device is able to move to the open position. Element 4: wherein the closure device is a flapper having a torsion spring, and wherein, when in the open position, the prop holds the flapper open and, when in the closed position, the prop is moved to allow the torsion spring to close the flapper. Element 5: wherein the closure device comprises a ball, and a ball seat defined on the upper mandrel and configured to receive and sealingly engage the ball when the closure device is in the closed position. Element 6: wherein the closure device comprises a ported end extending from or forming part of the prop, and one or more flow ports defined in the ported end and allowing the reverse-circulation fluid to bypass the reverse activated plug device when in the open position, and one or more sealing elements arranged on the ported end and configured to provide a sealed interface between the ported end and an inner wall of the upper mandrel when the reverse activated plug device is in the closed position. Element 7: wherein the reverse activated plug device further comprises a ported shoulder extending from or forming part of the prop, one or more flow ports defined in the ported shoulder and allowing the reverse-circulation fluid to bypass the reverse activated plug device when in the open position, and a sealing surface arranged on the ported shoulder and configured to seal against a seat defined on the upper mandrel when the reverse activated plug device is in the closed position. Element 8: further comprising a ball check arranged below the reverse activated plug device and providing an axial fluid passageway that allows a metered portion of a fluid to pass therethrough when the reverse activated plug device is in the open position.

Element 9: wherein the reverse activated plug device further comprises a biasing device arranged between the piston and the second end and configured to urge the piston toward the first end, one or more ports defined in the upper mandrel that place the piston chamber in fluid communication with the annulus, wherein, when a predetermined pressure differential between the annulus and an interior of the service tool is achieved, the piston moves toward the second end of the piston chamber and compresses the biasing device, and wherein decreasing a pressure within the interior of the service tool below the predetermined pressure differential allows the biasing device to move the piston toward the first end of the piston chamber and correspondingly move the prop such that the closure device is able to move to the open position. Element 10: wherein the closure device is a flapper having a torsion spring, and wherein, when in the open position, the prop holds the flapper open and, when in the closed position, the prop is moved to allow the torsion spring to close the flapper. Element 11: wherein the closure device comprises a ball and a ball seat defined on the upper mandrel and configured to receive and sealingly engage the ball when the closure device is in the closed position. Element 12: wherein the closure device comprises a ported end extending from or forming part of the prop, and one or more flow ports defined in the ported end and allowing the reverse-circulation fluid to bypass the reverse activated plug device when in the open position, and one or more sealing elements arranged on the ported end and configured to provide a sealed interface between the ported end and an inner wall of the upper mandrel when the reverse activated plug device is in the closed position. Element 13: wherein the reverse activated plug device further comprises a ported shoulder extending from or forming part of the prop, one or more flow ports defined in the ported shoulder and allowing the reverse-circulation fluid to bypass the reverse activated plug device when in the open position, and a sealing surface arranged on the ported shoulder and configured to seal against a seat defined on the upper mandrel when the reverse activated plug device is in the closed position. Element 14: further comprising a ball check arranged below the reverse activated plug device in the service tool and providing an axial fluid passageway that allows a metered portion of a fluid to pass therethrough when the reverse activated plug device is in the open position.

Element 15: wherein the piston chamber includes a first end and a second end, and a biasing device is arranged between the piston and the second end and urges the piston toward the first end, and wherein increasing the pressure of the reverse-out fluid within the service tool further comprises increasing the pressure past a predetermined pressure differential between the annulus and an interior of the service tool, the upper mandrel defining one or more ports that place the piston chamber in fluid communication with the annulus, moving the piston from the first end toward the second end of the piston chamber in response to the predetermined pressure differential, and compressing the biasing device as the piston moves toward the second end. Element 16: further comprising decreasing the pressure within the interior of the service tool below the predetermined pressure differential, moving the piston toward the first end of the piston chamber with the biasing device, and axially moving the prop such that the closure device is able to move to the open position. Element 17: wherein the closure device is a flapper having a torsion spring, and wherein moving the closure device from the open position to the closed position further comprises holding the flapper in a first position with the prop such that the reverse-circulation fluid is able to bypass the reverse activated plug device, and moving the flapper to a second position where the prop is axially moved to allow the torsion spring to close the flapper and thereby prevent the reverse-circulation fluid from bypassing the reverse activated plug device. Element 18: wherein the closure device comprises a ball and a ball seat defined on the upper mandrel, and wherein moving the closure device from the open position to the closed position further comprises holding the ball separated from the ball seat with the prop when the reverse activated plug device is in the open position, and thereby allowing the reverse-out fluid to bypass the ball, and axially moving the prop such that the ball is able to sealingly engage the ball seat and thereby preventing the reverse-circulation fluid from bypassing the reverse activated plug device. Element 19: wherein the closure device comprises a ported end extending from the prop, and wherein moving the closure device from the open position to the closed position further comprises allowing the reverse-circulation fluid to bypass the reverse activated plug device via one or more flow ports defined in the ported end when the reverse activated plug device is in the open position, and generating a sealed interface between the ported end and an inner wall of the upper mandrel when the reverse activated plug device is moved to the closed position, the sealed interface being generated by one or more sealing elements arranged on the ported end. Element 20: wherein the closure device comprises a ported shoulder extending from the prop, and wherein moving the closure device from the open position to the closed position further comprises allowing the reverse-circulation fluid to bypass the reverse activated plug device via one or more flow ports defined in the ported shoulder when the reverse activated plug device is in the open position, and sealingly engaging a sealing surface arranged on the ported shoulder with a seat defined on the upper mandrel when the reverse activated plug device is in the closed position. Element 21: further comprising receiving the reverse-out fluid at a ball check axially-offset from the reverse activated plug device within the service tool, sealingly engaging the ball check against a valve seat upon receiving the reverse-out fluid at the ball check, flowing a metered portion of the reverse-out fluid through an axial fluid passageway defined in the ball check, and maintaining hydrostatic pressure on the subterranean formation with the metered portion of the reverse-circulation fluid. Element 22: further comprising axially moving the first mandrel with respect to the second mandrel, and allowing a fluid to pass through the axial fluid passageway in order to mitigate swabbing effects on the subterranean formation.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A reverse-out valve, comprising:

an upper mandrel;

a lower mandrel movable with respect to the upper mandrel;

a reverse activated plug device arranged on the upper mandrel and including:

a piston chamber defined by the upper mandrel and providing a first end and a second end;

a piston movably arranged within the piston chamber;

a prop that extends longitudinally from the piston; and a closure device movable between an open position and a closed position, wherein, when in the open position, the piston is arranged at the first end and the prop holds the closure device open such that a reverse-circulation fluid is able to bypass the reverse activated plug device, and wherein, when in the closed position, the piston is arranged at the second end and the prop is moved to allow the closure device to close and thereby prevent the reverse-circulation fluid from bypassing the reverse activated plug device; and a ball check arranged below the reverse activated plug device and providing an axial fluid passageway that allows a metered portion of a fluid to pass therethrough when the reverse activated plug device is in the open position.

2. The reverse-out valve of claim 1, wherein the reverse activated plug device further comprises:

a biasing device arranged between the piston and the second end and configured to urge the piston toward the first end; and one or more ports defined in the upper mandrel that place the piston chamber in fluid communication with an exterior of the reverse-out valve, wherein, when a predetermined pressure differential between the exterior and an interior of the reverse-out valve is achieved, the piston moves toward the second end of the piston chamber and compresses the biasing device.

3. The reverse-out valve of claim 2, wherein the predetermined pressure differential is achieved when the reverse-circulation fluid within the interior of the reverse-out valve reaches a pressure threshold.

4. The reverse-out valve of claim 2, wherein decreasing a pressure within the interior of the reverse-out valve below the predetermined pressure differential allows the biasing device to move the piston toward the first end of the piston chamber and correspondingly move the prop such that the closure device is able to move to the open position.

5. The reverse-out valve of claim 1, wherein the closure device is a flapper having a torsion spring, and wherein, when in the open position, the prop holds the flapper open and, when in the closed position, the prop is moved to allow the torsion spring to close the flapper.

6. The reverse-out valve of claim 1, wherein the closure device comprises:

a ball; and a ball seat defined on the upper mandrel and configured to receive and sealingly engage the ball when the closure device is in the closed position.

7. The reverse-out valve of claim 1, wherein the closure device comprises:

a ported end extending from or forming part of the prop; and one or more flow ports defined in the ported end and allowing the reverse-circulation fluid to bypass the reverse activated plug device when in the open position; and one or more sealing elements arranged on the ported end and configured to provide a sealed interface between the ported end and an inner wall of the upper mandrel when the reverse activated plug device is in the closed position.

8. The reverse-out valve of claim 1, wherein the reverse activated plug device further comprises:

a ported shoulder extending from or forming part of the prop;

one or more flow ports defined in the ported shoulder and allowing the reverse-circulation fluid to bypass the reverse activated plug device when in the open position; and a sealing surface arranged on the ported shoulder and configured to seal against a seat defined on the upper mandrel when the reverse activated plug device is in the closed position.

9. A system, comprising:

a completion string disposable within a wellbore and including one or more sand screens;

a service tool arrangeable within the completion string such that an annulus is formed therebetween and including an upper mandrel and a lower mandrel movable with respect to the upper mandrel; and a reverse activated plug device arranged on the service tool and comprising:

a piston chamber defined by the upper mandrel and providing a first end and a second end;

a piston movably arranged within the piston chamber;

a prop that extends longitudinally from the piston; and a closure device movable between an open position and a closed position, wherein, when in the open position, the piston is arranged at the first end and the prop holds the closure device open such that a reverse-circulation fluid is able to bypass the reverse activated plug device, and wherein, when in the closed position, the piston is arranged at the second end and the prop is moved to allow the closure device to close and thereby prevent the reverse-circulation fluid from bypassing the reverse activated plug device; and a ball check arranged below the reverse activated plug device in the service tool and providing an axial fluid passageway that allows a metered portion of a fluid to pass therethrough when the reverse activated plug device is in the open position.

10. The system of claim 9, wherein the reverse activated plug device further comprises:

a biasing device arranged between the piston and the second end and configured to urge the piston toward the first end;

one or more ports defined in the upper mandrel that place the piston chamber in fluid communication with the annulus, wherein, when a predetermined pressure differential between the annulus and an interior of the service tool is achieved, the piston moves toward the second end of the piston chamber and compresses the biasing device, and wherein decreasing a pressure within the interior of the service tool below the predetermined pressure differential allows the biasing device to move the piston toward the first end of the piston chamber and correspondingly move the prop such that the closure device is able to move to the open position.

11. The system of claim 9, wherein the closure device is a flapper having a torsion spring, and wherein, when in the open position, the prop holds the flapper open and, when in the closed position, the prop is moved to allow the torsion spring to close the flapper.

12. The system of claim 9, wherein the closure device comprises a ball and a ball seat defined on the upper mandrel and configured to receive and sealingly engage the ball when the closure device is in the closed position.

13. The system of claim 9, wherein the closure device comprises:

a ported end extending from or forming part of the prop; and one or more flow ports defined in the ported end and allowing the reverse-circulation fluid to bypass the reverse activated plug device when in the open position; and one or more sealing elements arranged on the ported end and configured to provide a sealed interface between the ported end and an inner wall of the upper mandrel when the reverse activated plug device is in the closed position.

14. The system of claim 9, wherein the reverse activated plug device further comprises:

a ported shoulder extending from or forming part of the prop;

one or more flow ports defined in the ported shoulder and allowing the reverse-circulation fluid to bypass the reverse activated plug device when in the open position; and a sealing surface arranged on the ported shoulder and configured to seal against a seat defined on the upper mandrel when the reverse activated plug device is in the closed position.

15. A method, comprising:

arranging a completion string within a wellbore providing one or more zones of interest within a subterranean formation, the completion string including one or more sand screens arranged adjacent the one or more zones of interest;

introducing a service tool at least partially into the completion string and thereby forming an annulus therebetween, the service tool including an upper mandrel and a lower mandrel movable with respect to the upper mandrel;

conveying a reverse-out fluid into the service tool and past a reverse activated plug device arranged on the service tool, the reverse activated plug device comprising a piston movably arranged within a piston chamber defined by the upper mandrel, a prop that extends longitudinally from the piston, and a closure device;

increasing a pressure of the reverse-out fluid within the service tool and thereby moving the closure device from an open position, where the prop holds the closure device open, to a closed position, where the prop is moved to allow the closure device to close and thereby prevent the reverse-circulation fluid from bypassing the reverse activated plug device.

16. The method of claim 15, wherein the piston chamber includes a first end and a second end, and a biasing device is arranged between the piston and the second end and urges the piston toward the first end, and wherein increasing the pressure of the reverse-out fluid within the service tool further comprises:

increasing the pressure past a predetermined pressure differential between the annulus and an interior of the service tool, the upper mandrel defining one or more ports that place the piston chamber in fluid communication with the annulus;

moving the piston from the first end toward the second end of the piston chamber in response to the predetermined pressure differential; and compressing the biasing device as the piston moves toward the second end.

17. The method of claim 16, further comprising:

decreasing the pressure within the interior of the service tool below the predetermined pressure differential;

moving the piston toward the first end of the piston chamber with the biasing device; and axially moving the prop such that the closure device is able to move to the open position.

18. The method of claim 15, wherein the closure device is a flapper having a torsion spring, and wherein moving the closure device from the open position to the closed position further comprises:

holding the flapper in a first position with the prop such that the reverse-circulation fluid is able to bypass the reverse activated plug device; and moving the flapper to a second position where the prop is axially moved to allow the torsion spring to close the flapper and thereby prevent the reverse-circulation fluid from bypassing the reverse activated plug device.

19. The method of claim 15, wherein the closure device comprises a ball and a ball seat defined on the upper mandrel, and wherein moving the closure device from the open position to the closed position further comprises:

holding the ball separated from the ball seat with the prop when the reverse activated plug device is in the open position, and thereby allowing the reverse-out fluid to bypass the ball; and axially moving the prop such that the ball is able to sealingly engage the ball seat and thereby preventing the reverse-circulation fluid from bypassing the reverse activated plug device.

20. The method of claim 15, wherein the closure device comprises a ported end extending from the prop, and wherein moving the closure device from the open position to the closed position further comprises:

allowing the reverse-circulation fluid to bypass the reverse activated plug device via one or more flow ports defined in the ported end when the reverse activated plug device is in the open position; and generating a sealed interface between the ported end and an inner wall of the upper mandrel when the reverse activated plug device is moved to the closed position, the sealed interface being generated by one or more sealing elements arranged on the ported end.

21. The method of claim 15, wherein the closure device comprises a ported shoulder extending from the prop, and wherein moving the closure device from the open position to the closed position further comprises:

allowing the reverse-circulation fluid to bypass the reverse activated plug device via one or more flow ports defined in the ported shoulder when the reverse activated plug device is in the open position; and sealingly engaging a sealing surface arranged on the ported shoulder with a seat defined on the upper mandrel when the reverse activated plug device is in the closed position.

22. The method of claim 15, further comprising:

receiving the reverse-out fluid at a ball check axially-offset from the reverse activated plug device within the service tool;

sealingly engaging the ball check against a valve seat upon receiving the reverse-out fluid at the ball check;

flowing a metered portion of the reverse-out fluid through an axial fluid passageway defined in the ball check; and maintaining hydrostatic pressure on the subterranean formation with the metered portion of the reverse-circulation fluid.

23. The method of claim 22, further comprising:

axially moving the first mandrel with respect to the second mandrel; and allowing a fluid to pass through the axial fluid passageway in order to mitigate swabbing effects on the subterranean formation.

* * * * *